United States Patent [19]

Rodgers et al.

[11] 4,120,133

[45] Oct. 17, 1978

[54] METHOD OF CONSTRUCTING A TRANSPORTABLE PREFABRICATED ROOM ELEMENT

[75] Inventors: Franklin Bartlett Rodgers, Baar; Herbert Grässl, Ruswil, both of Switzerland

[73] Assignee: Credelca A.G., Zug, Switzerland

[21] Appl. No.: 491,532

[22] Filed: Jul. 24, 1974

Related U.S. Application Data

[63] Continuation of Ser. No. 366,276, Jun. 4, 1973, abandoned, which is a continuation of Ser. No. 121,992, Mar. 8, 1971, abandoned.

[51] Int. Cl.[2] ..... E04B 1/35

[52] U.S. Cl. ..... 52/745; 52/79.1; 52/79.9; 52/79.13; 52/227; 52/236.3

[58] Field of Search ..... 52/79, 223, 230, 143, 52/236, 295, 745, 747, 227

[56] References Cited

U.S. PATENT DOCUMENTS

| | | | |
|---|---|---|---|
| 2,691,291 | 10/1954 | Henderson | 52/236 |
| 3,460,308 | 8/1969 | Stuckey et al. | 52/747 |
| 3,503,170 | 3/1970 | Shelley | 52/236 |
| 3,550,334 | 12/1970 | Van Der Lely | 52/79 |
| 3,564,795 | 2/1971 | Henton | 52/236 |
| 3,568,380 | 3/1971 | Stucky | 52/79 |
| 3,722,168 | 3/1973 | Comm | 52/747 X |

FOREIGN PATENT DOCUMENTS

| | | | |
|---|---|---|---|
| 1,937,365 | 1/1970 | Fed. Rep. of Germany | 52/79 |
| 1,524,285 | 4/1968 | France | 52/227 |
| 6,804,097 | 10/1968 | Netherlands | 52/236 |

*Primary Examiner*—Leslie Braun
*Attorney, Agent, or Firm*—Brumbaugh, Graves, Donohue & Raymond

[57] ABSTRACT

A room element for a full-scale or small-scale building has a rigid frame or chassis consisting of a floor panel, composed of prefabricated panel sections rigidly connected in an end-to-end assembly by structural means, and prefabricated vertical load-bearing structures, rigidly connected to the panel adjacent the ends thereof, for supporting superimposed parts (e.g. the roof or ceiling, or a superimposed room element). At least one of the load-supporting structures may be integral with a panel section. The panel sections form the bases of the corresponding regions of the room element and at least one of them is incorporated in a three-dimensional prefabricated room element section, of unit form, which unit comprises such vertical load-bearing or non-load-bearing bearing structures substantially all the installations, required in that part of the completed room element. The unit may be a bathroom unit, staircase unit, heating unit, elevator shaft unit, or kitchen unit.

6 Claims, 40 Drawing Figures

INVENTORS
FRANKLIN BARTLETT RODGERS
HERBERT GRÄSSL

METHOD OF CONSTRUCTING A TRANSPORTABLE PREFABRICATED ROOM ELEMENT

This is a continuation of application Ser. No. 366,276 filed June 4, 1973, now abandoned, which is a continuation of application Ser. No. 121,992 filed Mar. 8, 1971 now abandoned.

SUMMARY OF THE INVENTION

This invention relates to buildings and specifically to transportable prefabricated room elements for erection into a single storey, or a plural storey, building. The expression "transportable prefabricated room element" means a prefabricated structure, consisting of part of a storey of a building, which is transportable and capable of being built and substantially finished in a factory and comprises a prefabricated floor panel and the whole of the vertical load-bearing structures associated with it in the completed room element, which prefabricated structure is capable of withstanding all forces imposed on it during transport, and during and after erection into the building, and is adapted to be mounted face-to-face with a further such room element in building up a storey or part of a storey of a building. The expression "face-to-face" includes side-by-side, end-to-end, and end-to-side. The expression "vertical-load bearing structure" includes a vertical load-bearing wall, a vertical load-bearing pillar or column, and spaced load-bearing pillars or columns. These columns may support "fill-in panelling" to close or partly close a face of the structure and the expression "fill-in panelling" includes a wall panel, a door or a window, and in the case of a wall panel the latter may be integral with two columns between which it extends or may be attached to them.

It has been proposed to fabricate such room elements on the basis of a load-bearing frame or chassis which consists of three initially separate components viz, a reinforced floor panel and two reinforced vertical load-bearing end structures, the latter being rigidly connected to opposite ends of the panel.

Such room elements are intended to be fabricated in a substantially complete manner at a factory remote from the building site. In particular such electrical wiring, plumbing and heating installations, doors, partitions, glazing and interior finish, as are required in the complete building are applied to the room elements at the factory so as to bring them to a substantially finished condition. The room elements are then transported to the building site and there assembled into a building to which only the minimum finishing work such for example as concealing joint lines needs to be carried out.

This system of building construction has recognised advantages but it also has its limitations. It will be appreciated that the size of the room elements is governed by transport considerations, and thus the maximum floor area of an individual room element is limited. This in turn means that in a storey of the finished building the frequency at which the vertical load-bearing structures occur is high. That is to say there are limits to the unobstructed area of floor that can be provided. Moreover, the mere bulk of the room elements renders special mechanical handling equipment necessary.

The floor panels should be made of reinforced concrete and hence their size and weight brings problems in their casting and handling. Also, the system does not readily permit room elements of various sizes to be constructed, for that would entail the use of a number of expensive moulds for the floor panels.

Moreover the use of a single prefabricated floor panel imposes a limitation on the size in which the room elements can be economically constructed.

Finally it will be appreciated that the room elements have to be prefabricated and finished while they are travelling along a production line. Their mere bulk renders transport along a production line difficult and the operations which have to be carried out in that production line render progress along it very slow. A further drawback is the limited access of workmen which renders it difficult for two teams to work simultaneously.

An object of the present invention is to make it possible to avoid some or all of the above-mentioned drawbacks.

The invention therefore provides a transportable prefabricated room element as hereinbefore defined, characterised in that (a) the floor panel comprises a plurality of prefabricated floor panel sections forming the bases of corresponding sections, or regions, of the room element and rigidly connected in an edge-to-edge assembly by structural means, and (b) at least one of the room element sections is prefabricated, prior to the edge-to-edge assembly, and comprises any vertical load-bearing structure, any vertical non-load-bearing structure, and any installations, provided in that region in the completed room element.

The invention also provides a transportable prefabricated room element as hereinbefore defined, characterised in that (a) the floor panel comprises a plurality of prefabricated floor panel sections rigidly connected in an edge-to-edge assembly by structural means, (b) at least one of the floor panel sections is incorporated in a prefabricated room element section of unit form and (c) this unit comprises at least one vertical load-bearing structure rigidly fixed to the panel section, and/or any non-load-bearing wall required in that part of the completed room element.

According to an important feature of the invention, the floor panel sections and the vertical load-bearing structures are fixed together to form a rigid frame or chassis. This mode of construction has considerable advantages, one of which is that it removes the size limitations hitherto imposed by the use of a single floor panel and also permits larger unobstructed floor areas in the resultant building than has hitherto been practicable. It also facilitates the installation, at an early stage in the prefabrication, of such items as electrical wiring, plumbing and heating installations, doors, partitions, glazing, and interior finish, as are required in the completed building.

The floor panel sections may be connected together by various structural means:- for example, by post-tensioning means extending between the ends of the room element or by structural beams extending lengthwise of the floor panel. Each beam may be constituted by beam sections, one for each panel section, united end-to-end.

The dimensions of the room element may conform to the standard for transportable containers which, at present is 40 ft. (12.18m) long and 8 ft. (2.43m) wide. The height is not critical but it may be 8ft.

The prefabricated room element section may incorporate a roof or ceiling.

The aforesaid prefabricated room element section may be a bathroom unit, staircase unit, a heating unit, elevator shaft unit, a kitchen unit, or any other region of the room element which is capable of being prefabricated as a unit. The room element may be composed, substantially throughout of prefabricated three-dimensional room element sections.

The invention also includes a prefabricated section for the aforesaid room element, and a building comprising a plurality of the transportable prefabricated room elements.

The invention also provides a method of constructing a transportable prefabricated room element as hereinbefore defined which comprises:

(a) prefabricating sections of the room element, each of which room element sections comprises a section of the floor panel and any vertical load-bearing and non-load-bearing structures associated with that panel section in the completed room element, (b) applying to the room element sections substantially all installations, glazing, and surface finish associated with that room element section in the completed room element, (c) assembling said room element sections edge to edge, and (d) rigidly connecting said room element sections by structural means, such means uniting the assembled floor panel sections and vertical load-bearing structures into a complete structural frame.

In order that the invention may be better understood, reference will now be made to the accompanying drawings, in which:

FIGS. 7 to 10 illustrate locations for the joint between an end structure and the adjacent floor panel section; while

FIGS. 12 to 15 illustrate joints between an intermediate load-bearing structure (e.g. a wall) and adjacent panel sections; while

Figure 4:
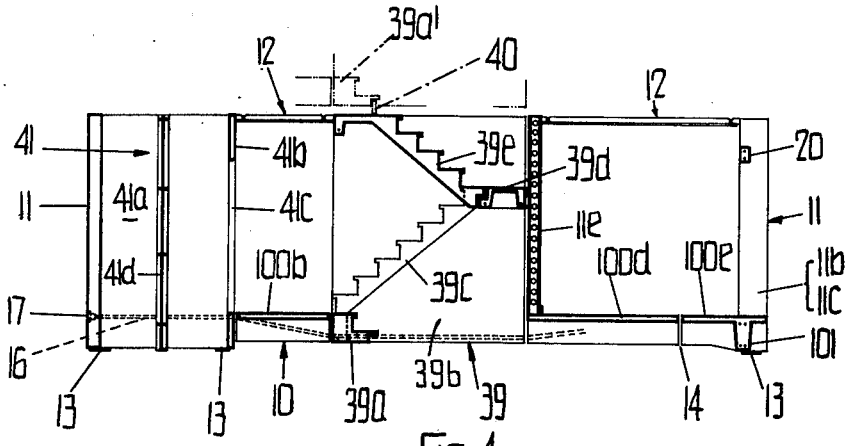
FIG. 4 illustrates a still further frame.

Turning to FIG. 4 the rigid load-bearing frame therein illustrated comprises a floor panel 10 to each end of which there is rigidly attached a vertical load-bearing structure 11, which structures support a ceiling 12 comprising a ceiling frame **12*a* connecting said members 11 under tension and a surface layer 12*b*. However, instead of the floor panel 10 being constituted by a single prefabricated component it is built up from a plurality of prefabricated and factotry-finished floor panel sections 10*a* to 10*c*** assembled edge-to-edge and structurally connected by means uniting them into a complete load bearing structure capable of supporting the loads imposed on the floor of the eventual room element in the finished building and during transport of the room element. Each floor panel section constitutes the base of a section, or region, of the room element and has applied to it such load-bearing and non-load-bearing structure, and substantially all the installations (e.g. plumbing, glazing, heating and lighting conductors, internal and external walls, doors, and surface finish) that are required to be present in that part of the completed room element. As hereinafter appears, at least one of the panel sections may form the base of a prefabricated room element section.

The end structures 11 are factory finished, and they, and the floor panel sections, may be made of precast (and preferably, reinforced) concrete.

The structure which is thus fabricated at the factory constitutes a room element as hereinbefore defined which can be transported to the building site and there erected into a building. The dimensions of the room element preferably conform to the standard for transportable containers that is to say, it is 40 ft. (12.18m) long and 8 ft. (2.43m) wide and preferably 8 ft. high although the height is not critical. For this purpose there may be, at each corner, a suitable fitting, conforming to the International Standards Organisation standards (I.S.O Draft 1019 Revised) for container fittings, allowing the room element to be handled by standard container-lifting and handling equipment.

Figure 5:
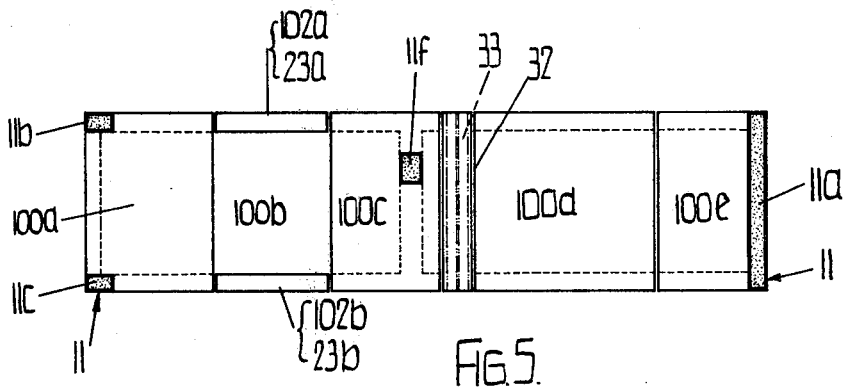
FIG. 5 is a plan view illustrating an alternative arrangement.
Figure 6:
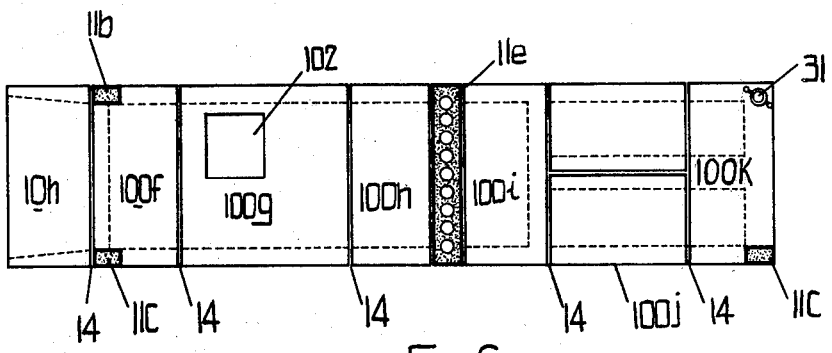
FIG. 6 is another such plan view.

One or each end structure 11 may consist of a complete load-bearing end wall **11*a* as in FIG. 5 or a single vertical load-bearing pillar or column as illustrated at 11*c* in FIG. 6, or two spaced load-bearing pillars or columns as illustrated at 11*b* and 11*c* in FIG. 5**. Such spaced pillars or columns may have fill-in panelling (e.g. a door or window) between them.

The number of panel sections **10*a* to 10*e* which are employed depends on the desired length of the floor panel 10 and on the length of the individual panel sections. Some or all of the panel sections may be of identical lengths but, as illustrated in FIG. 1**, panel sections of differing lengths may be incorporated.

The panel sections **10*a* to 10*e* and the end structures 11 are assembled together with a setting filling (e.g. mortar or molten metal) in the joints 14 between their adjacent end faces. The components are assembled and connected together at a factory, in a jig (for example according to British Patent 1,109,873), the manufacturing tolerances of the various components being taken up in the filled joints 14** so that the overall linear and angular dimensions of the finished structure are accurately determined by the jig.

Alternatively, some or all of the joints may be made by direct contact of finished faces of the panel sections as indicated at 14[1].

Figure 1:
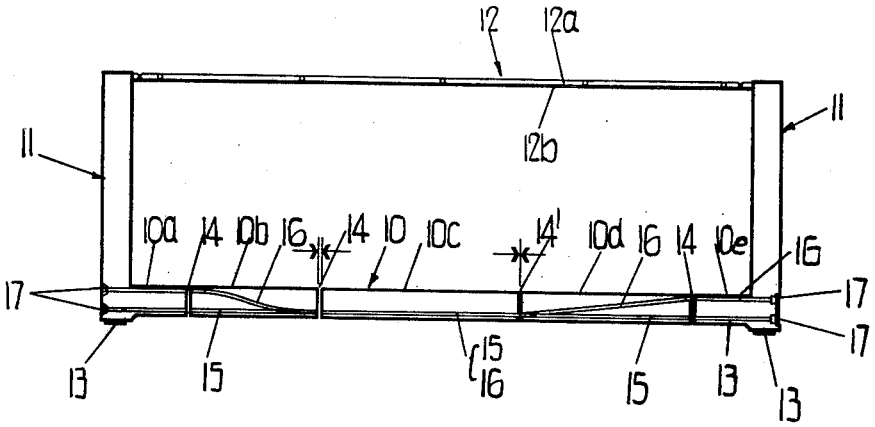
FIG. 1 is a diagram showing, in sectional elevation, the rigid load-bearing structural frame of a room-element according to this invention.

In the arrangement illustrated in FIG. 1, the panel sections are provided with conduits 15, 16 (e.g. cast-in tubes) for post-tensioning cables which are threaded through them, the cables being tensioned and their ends anchored by anchorages 17 of conventional form. There are preferably two such conduits 15, 16 near each side of the floor panel as will be appreciated from FIGS. 21 to 23 and FIG. 40. Conduits 15 extend substantially horizontally but conduits 16 have a generally bowed formation so that the upper cables resist any tendency of the floor panel to sag in the middle, and for further structural reasons.

Figure 2:
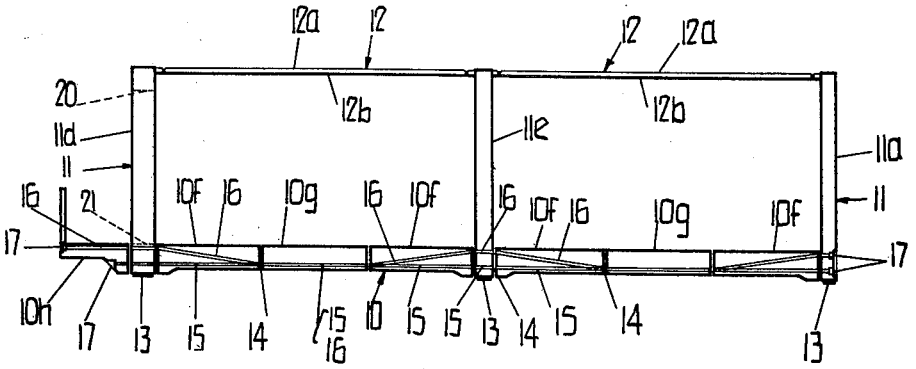
FIG. 2 illustrates another such frame.

In FIG. 1 the floor panel sections 10*a*, 10*e* are shown as being integral with the adjacent end structures 11, so that the first floor panel joint 14 is spaced inwards from the adjacent end structure. In FIG. 2 the prefabricated end structures 11*a*, 11*d* are initially separate from the adjacent panel sections 10*f* but rigidly connected thereto in the finished article, for example, by the post-tensioning means. This FIG. shows that there may be a floor panel section 10*h* protruding at the outside of at least one end structure 11*d* to form a balcony. This FIG. also shows that there may be an intermediate vertical load-bearing structure 11*e* (which may comprise a complete load-bearing wall dividing the room element into two, or may comprise one or more columns or pillars); parts of the ceiling 12 are supported by this structure 11*e*.

If a load-bearing structure 11 or 11*e* comprises spaced vertical pillars, these may be integrally joined by an upper cross-member 20 and/or at the base by a cross-member 21.

Figure 3:
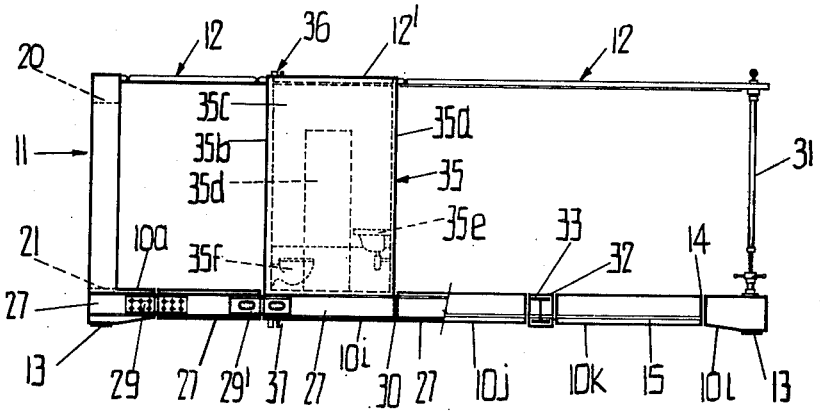
FIG. 3 illustrates a further frame and shows various methods of connecting the panel sections together.

FIG. 3, in conjunction with FIGS. 17 to 20, illustrates various ways in which the end structures and the floor panel sections may be rigidly and permanently connected.

Figure 17:
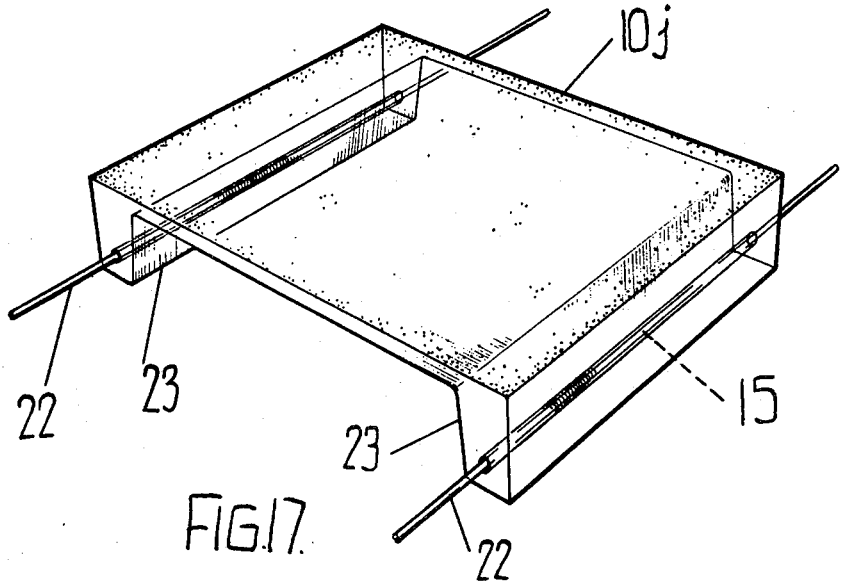
FIGS. 17 to 20 are perspective views of floor panel sections illustrating various manners in which they may be rigidly connected together in the frame.
Figure 18:
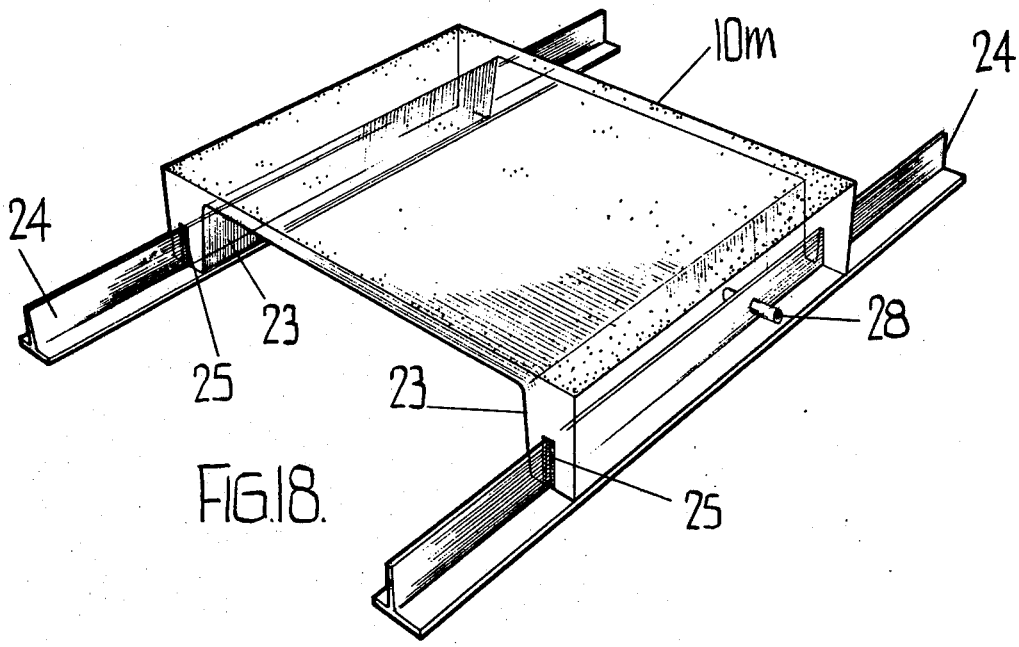
Figure 19:
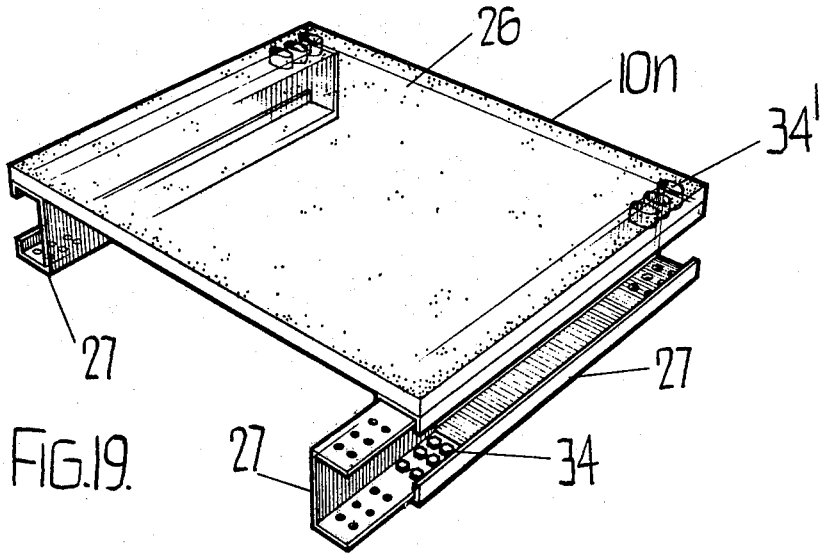
Figure 21:
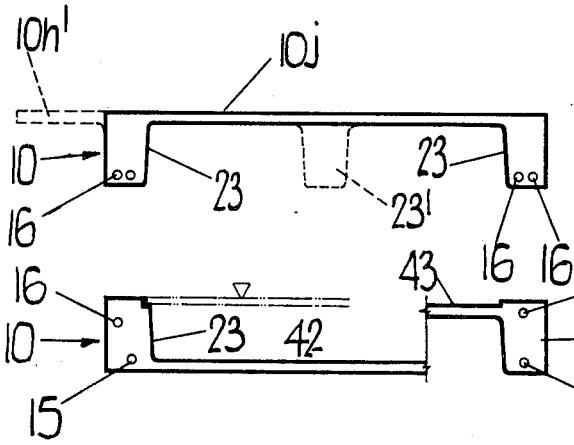
FIGS. 21 to 24 show various cross-sectional forms of pre-stressed concrete panel sections.
Figure 40:
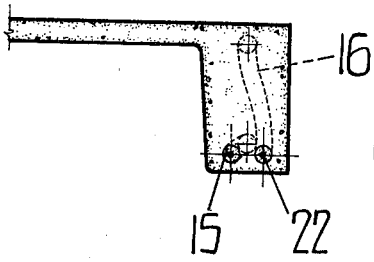

In FIGS. 17 and 21, and 40, the tubes 15 for the tensioning cables 22 are embedded in ribs 23 at the underside of the respective pre-cast panel section 10*j*. A panel section may have an intermediate rib 23'. The floor panel may have a sideways cantilever extension 10*h*.

Figure 20:
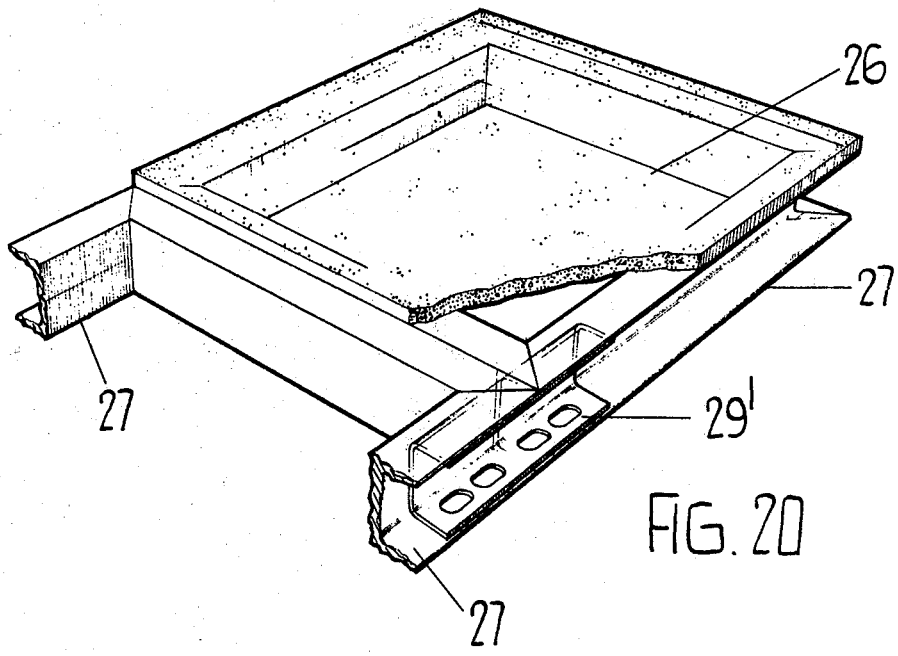
Figure 39:
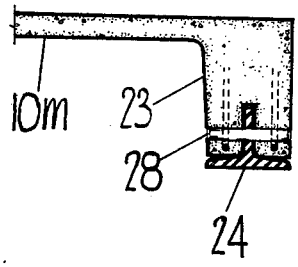

Alternatively, the panel sections may (as shown by the representative section 10*m* in FIGS. 18 and 39) have their ribs 23 provided with longitudinal slots 25 which receive the vertical webs of T-section beams 24 being fixed thereto by an adhesive filling such as an epoxy mortar and if desired by pins 28 fitted in machined holes. Such beams may extend for substantially the full length of the room element or may be constituted by beam sections, one for each panel section, united end-to-end. Thus in FIGS. 19 and 35 the representative panel section 10*n* comprises a precast panel 26 fixed upon C-shaped beam sections 27 (for example, by means of studs 28') which beam sections extend along beneath its opposite side margins, successive beam sections 27 being bolted together by means of fish-plates 29, access holes 34' being provided for the bolts 34. Alternatively, as shown in FIG. 20 successive beam sections may have the fish-plates 29' welded to them. In this Figure, the beam sections 27 for each representative floor panel section form the side members of a rectangular metal frame on which the precast slab 26 is secured. In a further alternative illustrated in FIG. 3 adjacent ends of the beam sections are resistance-welded together as at 30.

Figure 22:
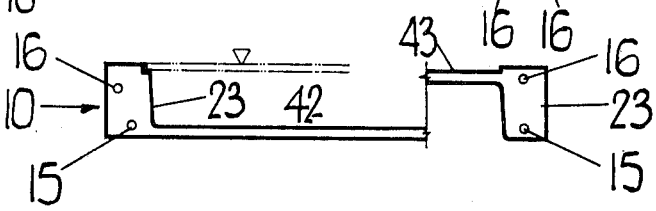
Figure 23:
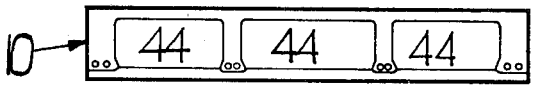
Figure 24:
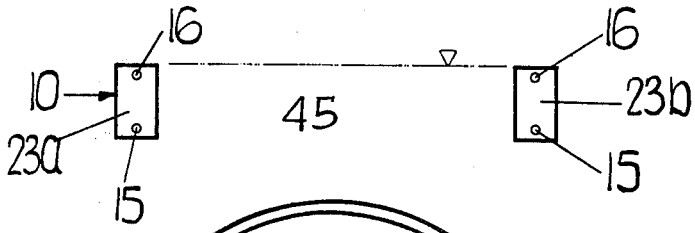
Figure 25:
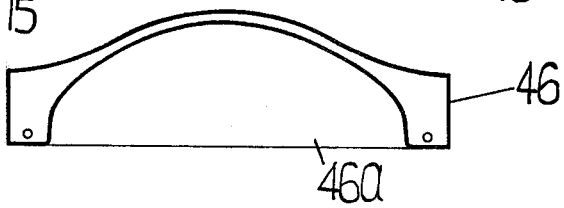
FIG. 25 is a cross-section through a vaulted roof section.

FIG. 22 shows that a panel section may have a deep well (e.g. for services) or shallow depression 43 (e.g. for a carpet, mat, or tile inlay). FIG. 23 shows that it may be formed by extrusion with cavities 44. FIG. 24 shows that it may for a whole or part of its length be constituted by longitudinal members 23*a*, 23*b* with an opening 45 between them. FIG. 25 shows a precast vaulted roof section 46 provided at least at one location with a cross diaphragm 46*a* to stiffen it.

Figure 35:
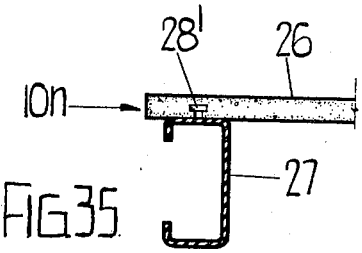
FIGS. 35 to 40 are sectional views illustrating various panel sections.
Figure 38:
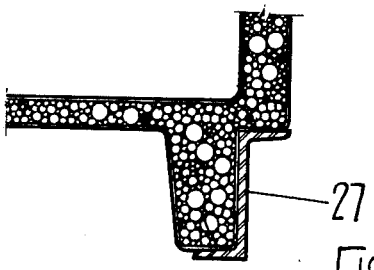
Figure 36:
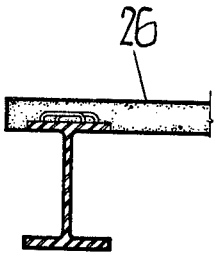
Figure 37:
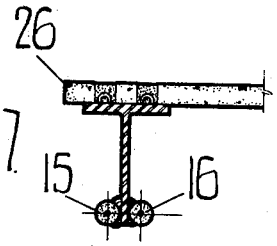

Referring now to FIGS. 36–38, FIG. 36 shows an alternative to FIG. 35 using an I-section beam and shear stirrups for connecting the slab 26.

FIG. 37 shows a construction alternative to FIGS. 21 and 40, in which the tubes 15, 16 for the cables 22 are welded to the web of the beam and, after the cables have been threaded, mortar grout is injected.

FIG. 38 illustrates how a moulded panel section or room element may be supported using a Z-shaped beam.

It may be desirable to omit a column 11*b* or 11*c* from at least one corner of the room element, in which case the frame is provided with a temporary support column 31, FIG. 3, as in U.S. Ser. No. 844,384. This column 31 temporarily supports the ceiling 12 during manufacture and transport of the room element and, if desired until the ceiling has been attached to the floor panel of a superimposed room element in the next upper storey of the building. It may also serve to support the superimposed room element until the floor panel of the latter has been structurally connected to an adjacent floor panel in said upper storey by reinforcing means whereby the adjacent floor panels afford mutual support to each other. For this purpose FIGS. 3 and 5 show, interposed between adjacent floor panel sections, a narrow section 32 in which a steel cross beam 33 is embedded. The reinforcement means is provided by rigidly connecting the ends of the cross beams 33 of adjacent floor panels, for example by welding, during the construction of the building and before the temporary column 31 is removed. If the panel sections at either side of this section 32 are connected by tensioning cables or rods these pass through that section and through the beam 33 as illustrated in FIG. 3. If desired the beam 33 may be provided at or near the end of the floor panel.

FIG. 3 also illustrates the fact that the structure incorporates at least one complete three-dimensional, prefabricated, sectional unit 35 of the room element. This unit room element section comprises a floor panel section 10*i* and any vertical load-bearing and non-load-bearing structure required to be associated with that panel section in the completed room element. The unit is here illustrated as a toilet unit having vertical walls 35*a*, 35*b* and 35*c*, door 35*d*, and washbasin 35*e* and toilet pan 35*f*. It further comprises the appropriate section 12', of the roof, and all installations, glazing, and surface finish which are necessary. The plumbing and other service connections are indicated at 36 and 37.

In FIG. 4 there is shown a prefabricated room element section in the form of a staircase unit 39 having a floor panel section 39*a*, at least one load-bearing side wall 39*b*, a lower stair flight 39*c*, a landing 39*d*, and an upper stair flight 39*c*. 39*a*' indicates the floor panel section of a superimposed room element and 40 a filler piece. That Figure also shows a lift shaft unit 41 having load-bearing walls 11 and 41*a* and a non-load bearing wall 41*b* with a doorway 41*c*. Guides for the lift cage are indicated at 41*d*. Further floor panel sections are shown at 100*b*, 100*d* and 100*e* the latter being integral with pillars 11*b*, 11*c* and having cross rib 101.

FIG. 5 is a plan view incorporating floor panel sections 100*a*, 100*b*, 100*c*, 32, 100*d* and 100*e*. Section 100*a* is integral with pillars 11*b*, 11*c* and section 100*e* is integral with load-bearing end wall 11*a*. Section 100*b* is integral with load-bearing side walls 102*a* and 102*b* (or longitudinal members 23*a*, 23*b*) while section 100*e* has a load-bearing pillar 11*f* at any suitable location.

FIG. 6 is a plan showing floor sections 10*h* and 100*f* to 100*k*. Panel section 100*f* is integral with pillars 11*b*, 11*c*. Panel section 100*g* may have any desired aperture 102 (for a duct, stair, or plumbing). Panel section 100*j* comprises two side-by-side panels 100*j*[1] and 100*j*[2]. Panel section 100*k* is integral with a corner pillar 11*c* and is provided with a temporary column 31.

Figure 7:
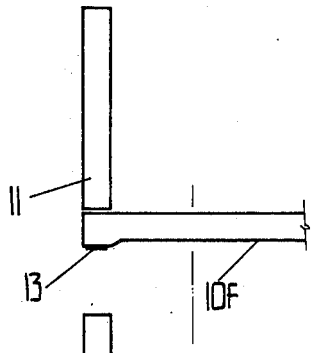
Figure 8:
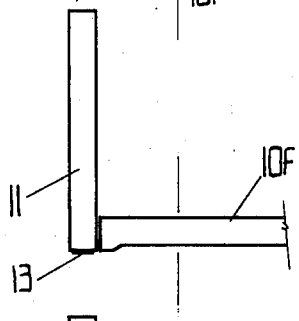
Figure 9:
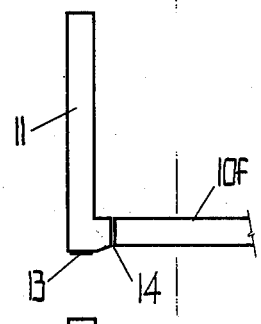
Figure 10:
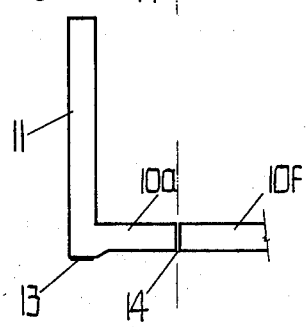
Figure 11:
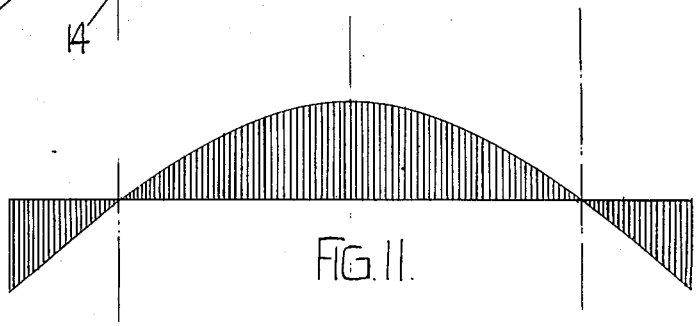
FIG. 11 is the bending moment diagram associated with FIGS. 7–10.
Figure 12:
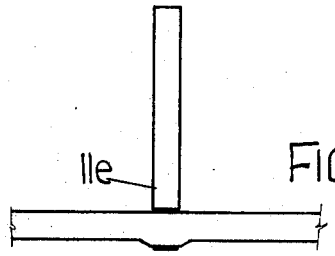
Figure 13:
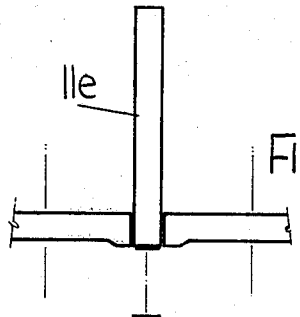
Figure 14:
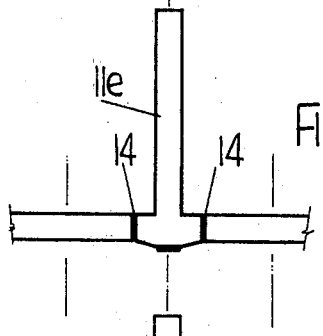

FIG. 7 shows that the end structure 11 may be mounted on top of the panel section 10*f* (e.g. by means of a joint according to British Patent No. 1,101,597), while FIG. 8 shows that it may be fixed against the end of that panel section. FIG. 9 shows that the joint 14 may be displaced inwards, and FIGS. 10 and 11 show that this joint may, as preferred, be located at a position where the bending moment is substantially zero or is very small.

Figure 15:
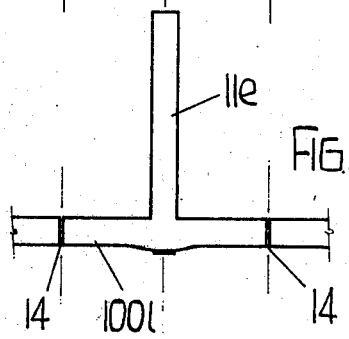
Figure 16:
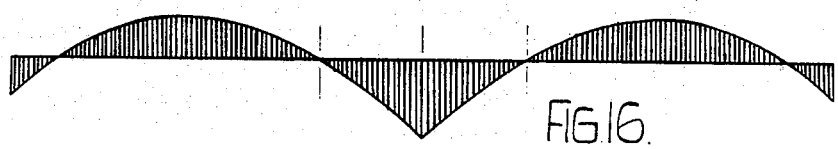
FIG. 16 is a bending moment diagram associated with FIGS. 12–15.

FIGS. 12 to 15 show various ways in which an intermediate load-bearing structure or wall 11*e* may be arranged. In particular, FIG. 15 shows that this intermediate structure 11*e* may be integral with the floor panel section 100 *l* and in conjunction with FIG. 16 shows that the joint 14 may be disposed at a region where the bending moment is substantially zero or is very small.

Figure 26:
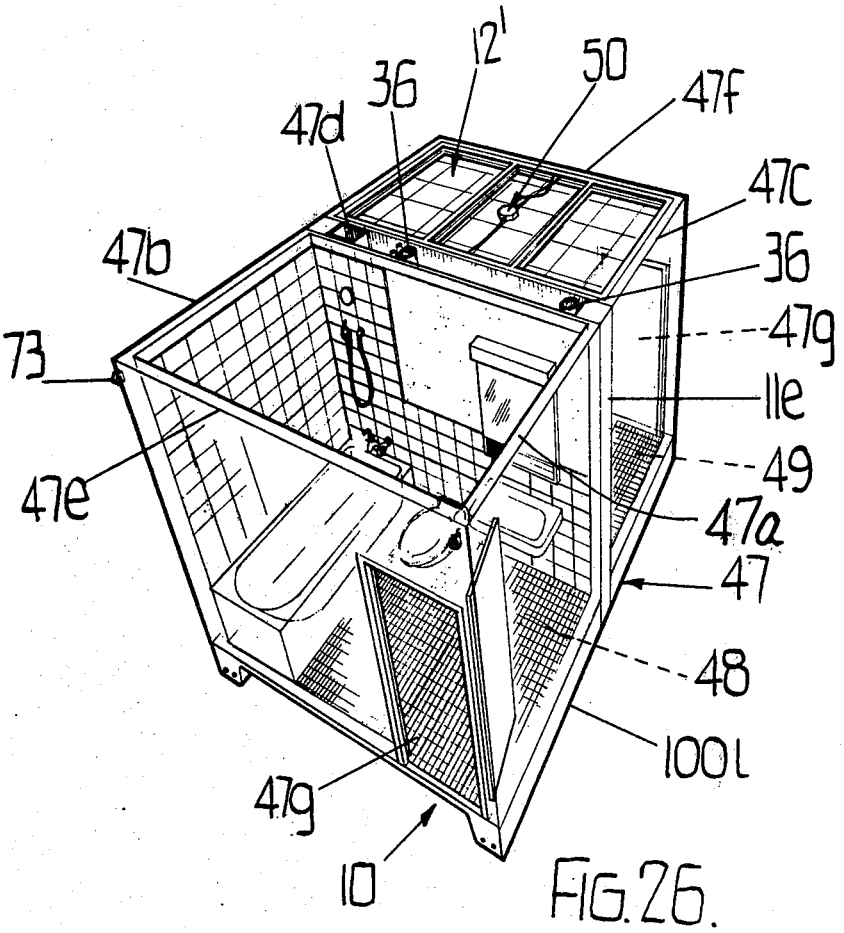
FIG. 26 is a perspective view of a bathroom unit with a portion of the ceiling removed.

FIG. 26 shows a prefabricated unit or room element section 47 which incorporates two bathrooms 48, 49 separated by a load-bearing wall 11*e* which may be integral with a floor panel section 100 *l*. This element section has side walls 47*a* to 47*d* and end walls 47*e* and 47*f*; these walls may be load-bearing or non-load-bearing. Walls 47*e* and 47*f* each incorporate a door and doorway such as 47*g* and, as will be seen, each bathroom incorporates substantially all those installations and interior fittings which are appropriate to a bathroom. For convenience in illustration, the ceiling 12' is omitted from the bathroom 48. The electric leads and ceiling fitting for the illumination, and power points, of bathroom 49 are indicated generally at 50.

Figure 27:
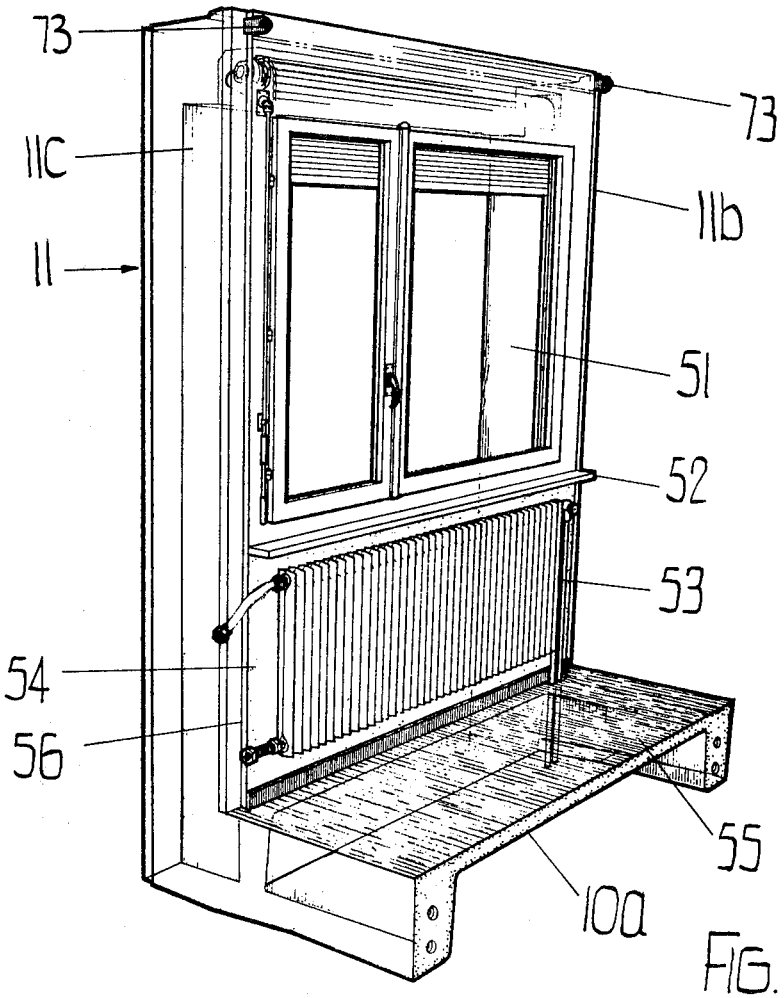
FIG. 27 is a perspective view of a load-bearing end structure integral with a panel section.

FIG. 27 illustrates a room element section comprising a floor panel section 10*a* having integral with it a vertical load-bearing structure 11 which comprises spaced load-bearing pillars 11*b*, 11*c* between which there is a window 51. Below the latter there is a window sill 52 and a radiator 53. An interior surface finish, such for example as wallpaper, is indicated at 54 and floor covering at 55. 56 indicates an applied wood or other panel.

Figure 28:
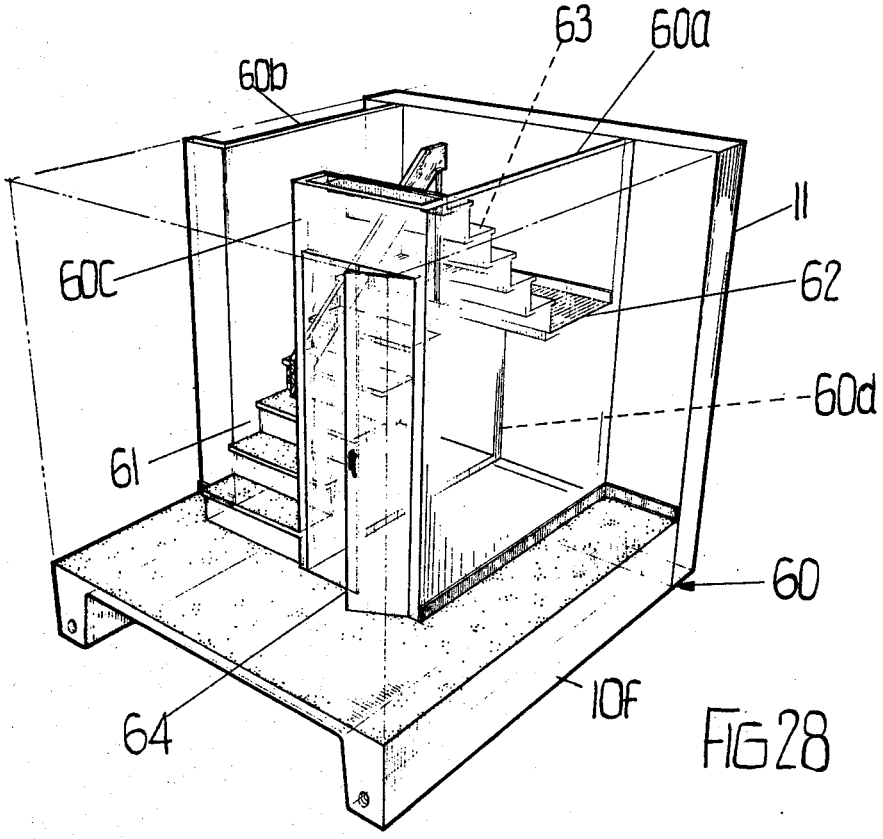
FIG. 28 is a perspective view of a staircase unit.

FIG. 28 illustrates a room element section constituted by a stair unit 60 having a floor panel section 10*f*, load-bearing end wall 11, and internal partition walls 60*a*, 60*b*, 60*c*, 60*d* at least some of which may be load-bearing. The unit contains the first flight of stairs 61 leading up to a landing 62 and a second flight 63 leading upwards from the latter. The space beneath the stairs may be provided with at least one door 64 in the wall 60*c*. Walls 60*a*, 60*b* may be stiffening walls to stiffen the end wall 11 against wind pressures. Suitable interior finish is applied at the factory to the panel section, walls, stairs, and other parts.

Figure 29:
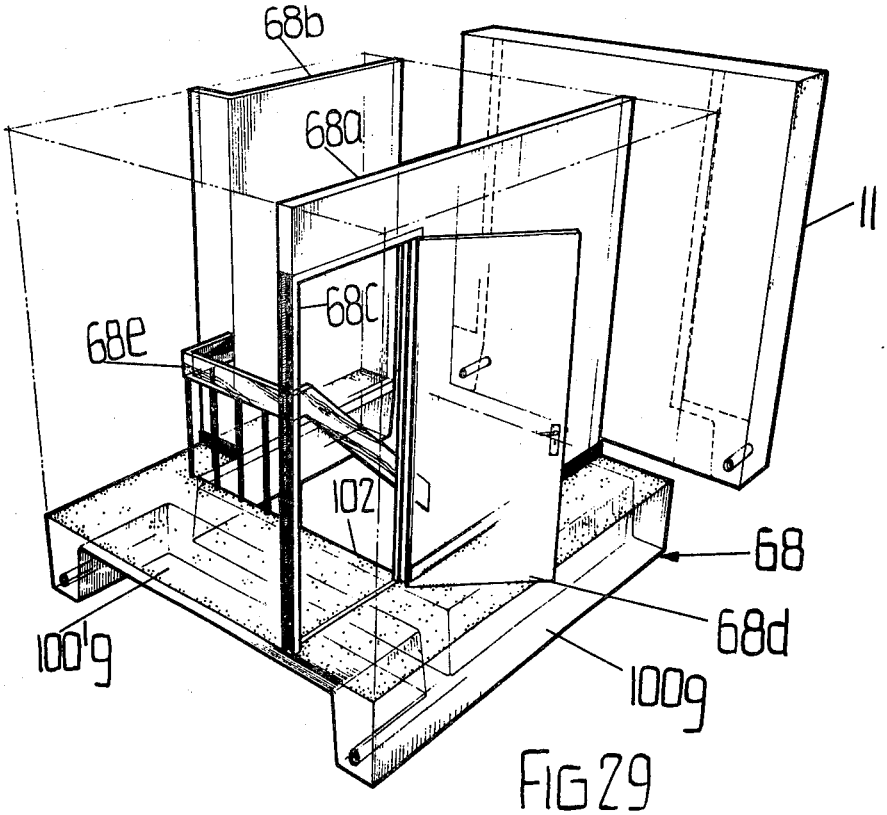
FIG. 29 is a perspective view of a stair-head unit.

FIG. 29 shows a stair head unit 68 primarily intended to be superimposed on the staircase unit 60 of FIG. 28. It comprises a floor panel section 100*g* having a stairhead opening 102 and a load-bearing end wall 11 which for convenience in the illustration is shown in detached position. The unit also comprises interior parition walls 68*a*, 68*b* (which may be load-bearing or non-load-bearing), wall 68*a* having a doorway leading from the landing portion 100*g* of the panel section and provided with a door 68*d*. The frame of the doorway may be made of pressed steel. The unit is further provided with a bannister or handrail 68*e*. The component parts of the unit are given appropriate internal and external finish at the factory where the unit is constructed.

Figure 30:
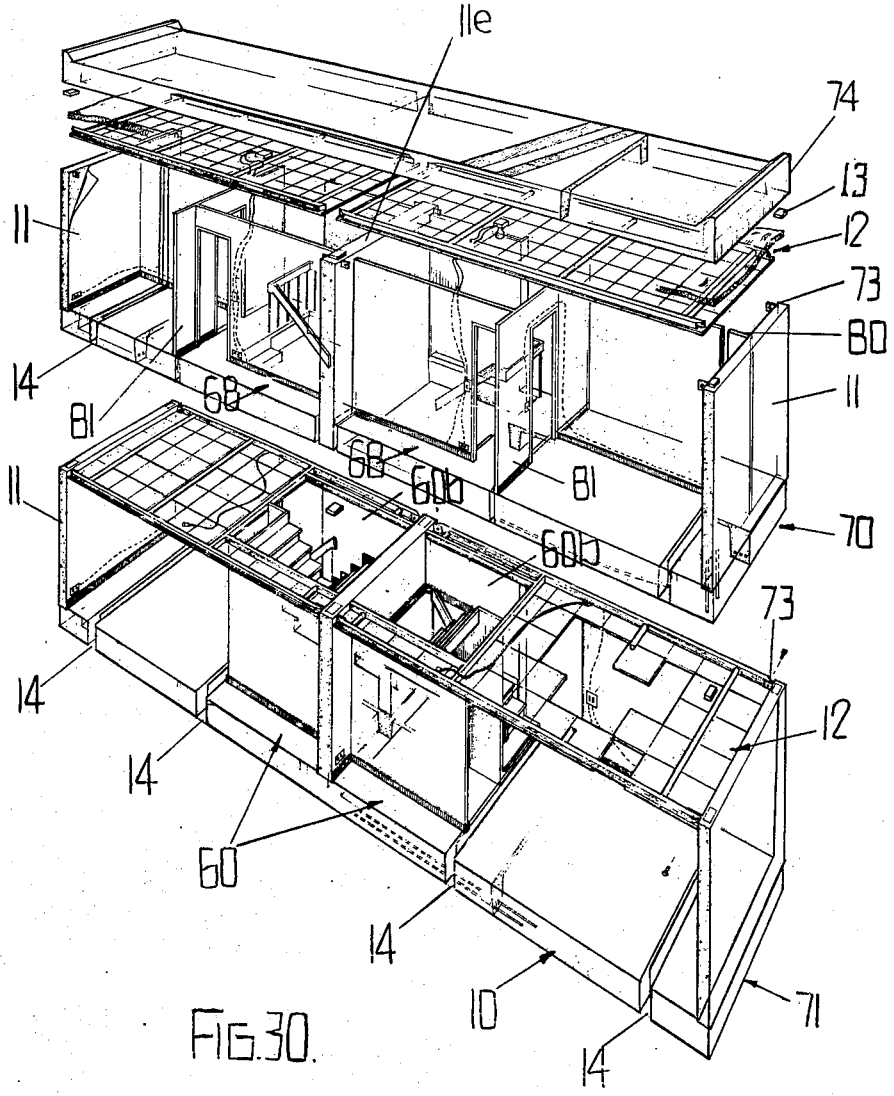
FIG. 30 is a perspective view showing upper and lower room elements according to this invention.

FIG. 30 shows upper and lower room elements 70, 71 according to this invention. Each room element comprises a floor panel 10 built up as hereinbefore described, load-bearing end walls 11, a load-bearing intermediate wall 11*e* which divides each room element into two separate portions, and a ceiling 12. Each portion of the lower room element 71 incorporates a staircase unit 60 as in FIG. 28 and each portion of the upper room elements 70 incorporates a stair head unit 68 as in FIG. 29. The ceiling 12 is bolted to the walls 11, 11*e* by lugs 73 provided at the top corners of the latter. The upper room element 70 is shown as having a prefabricated roof 74 which may be monolithic or built up of sections in a manner similar to the floor panel 10. The roof panel or its sections may be of precast concrete or other construction. Under each corner of each floor panel, and each corner of the roof 74, there may be a resilient bearing pad 13 of neoprene (see also FIGS. 1–4).

Figure 32:
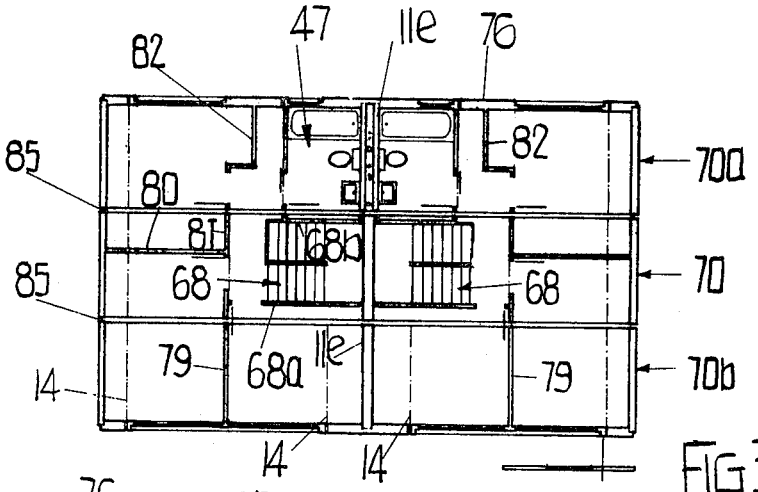
FIGS. 31 and 32 are respectively the ground floor and upper floor plan of a building incorporating room elements according to FIG. 30.
Figure 31:
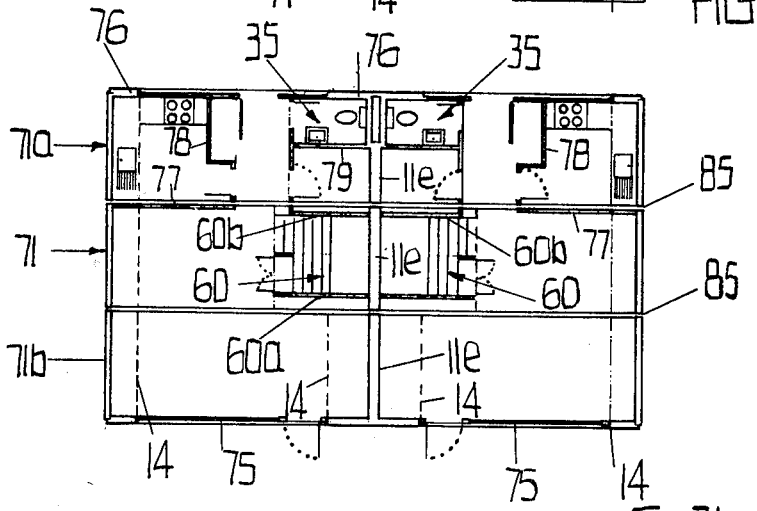

FIGS. 31, 32 show how room element 71 may be mounted side by side with other room elements 71*a*, 71*b* according to this invention. FIG. 32 shows a similar arrangement of room elements 70, 70*a* and 70*b*. The outer faces of room elements 70*a*, 70*b*, 71*a*, 71*b* are closed by exterior walls 75, 76 which may incorporate doors and windows. The intermediate walls 11*e* of adjacent room elements are in the same plane and serve to divide the building into two identical dwellings. In the ground floor, the room elements 71 and 71*b* are in open communication at the joint face between them so as to provide an unobstructed floor area of very substantial size, the plan form of which is not dependent upon the plan form of the room elements. Other areas of the ground floor are sub-divided into rooms by non-load bearing internal partition walls 77, 78 and 79. Such walls are erected on floor panel sections and form part of room element sections according to this invention.

In the upper storey, the successive room elements 70*a*, 70*b* are wholly or partly in open communication at the joint faces between them, the floor area being subdivided into rooms by non-load bearing internal parition walls 79, 80, 81 and 82 etc. These walls do not coincide with the joint faces 85 between successive room elements so that the plan form of the rooms is independent of the size and shape of the room elements.

Figure 33:
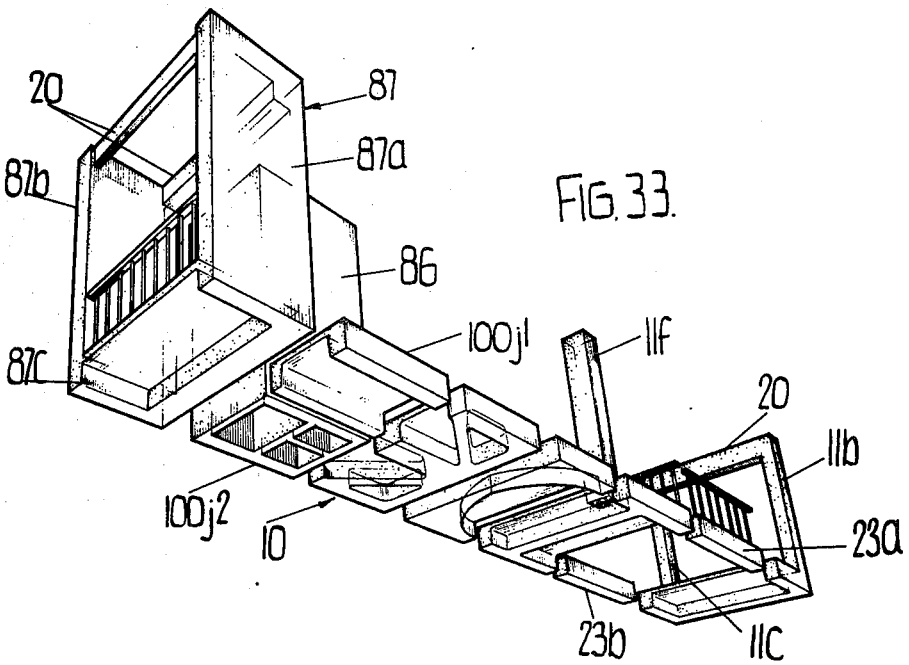
FIGS. 33 and 34 are perspective views of room elements, looking from below, showing as examples various forms of panel sections and room element sections.
Figure 34:
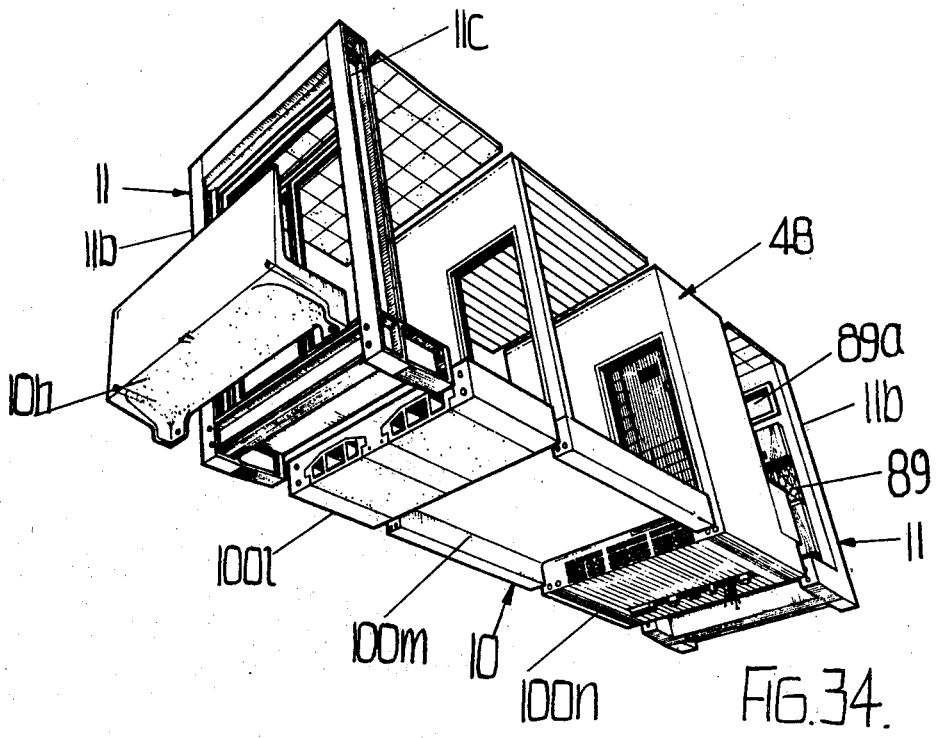

Turning now to FIGS. 33 and 34, these show various practicable shapes for the panel sections which may be employed in any useful combination in a floor panel.

FIG. 33 also shows a chimney 86 integral with panel section 100*j*[2], and also shows a loggia 87 which comprises load-bearing side walls 87*a*, 87*b* integral with a base section 87*c* and connected by lintels 20.

The room element shown in FIG. 34 comprises a bathroom section 48, and a kitchen section 89 at one end of the floor panel 10. The section 89 comprises spaced load-bearing pillars (of which only one is shown at 11*b*) integral with a panel section, and is completely fitted out and has a window 89*a*. That part of the kitchen which requires plumbing and other services is provided on section 48.

At the other end of the room element there is a load-bearing structure 11 which is prefabricated from structural metal profiles and comprises spaced load-bearing pillars 11*b*, 11*c*. It has a balcony 10*h* attached to it, which may be a plastics moulding. Floor section 100 *l* may be made of light-weight concrete with voids formed of hollow concrete or ceramic tile sections. Floor section 100*m* is made of a high-strength structural material and floor section 100*n* may be made of a ceramic or plastics material and may be moulded integrally with the walls of unit 48.

It will be understood that the transportable prefabricated room element is a cell-like structure having two opposed ends and two opposed sides constituting four faces of the cell, and comprises a floor panel, a roof and/or ceiling, and vertical load-bearing structures rigidly connected to the floor panel, at or adjacent to opposite ends of the latter, for supporting superimposed parts of the building (such for example as the roof or ceiling, or a superimposed room element), and that the room element is adapted to be mounted face-to-face with at least one further room element in building-up a storey, or part of a building. The room element is provided with a rigid structural frame such as is illustrated in FIGS. 1–6, composed of prefabricated components some or all of which are substantially two-dimensional. The floor panel of this frame comprises prefabricated panel sections which are rigidly connected in and edge-to-edge assembly by structural means: each panel section forms the base of a section, or region, of the room element and at least one of (and, if desired, each of) the panel sections is prefabricated (prior to the edge-to-edge assembly) into a unitary three-dimensional room element section which is then incorporated, as a unit, into the frame during the construction of the latter. The various components, including such units or room element sections, are substantially finished at a factory prior to assembly although it may be preferred to defer the installation of minor items (such for example floor covering, wiring, etc) to a later stage. The various components are made in or brought to an assembly factory and there assembled into complete room elements. The room elements are transported from the factory to the building site and there assembled into a building.

This invention is not only applicable to full-scale buildings and their components, but also to small-scale buildings (such as toys or scale models) and their small-scale components.

What is claimed is:

1. A method of erecting a plural-storey building in which at least two uperimposed storeys comprise transportable prefabricated room elements constructed from room element sections, each room element being a cell-like structure, having two opposed sides and two opposed ends constituting four vertical faces of the cell, and comprising a rigid floor panel structure and a vertical load-bearing structure, of room height, rigidly connected to the floor panel structure adjacent to an end of the floor panel structure, the room elements being prefabricated at a factory remote from the building site by rigidly fixing the load-bearing structure to the floor panel structures, which room elements are subsequently transported from the factory to the building site and there disposed face-to-face in each of the said storeys with the room elements of each upper storey stacked on the room elements of the next lower storey and supported by the load-bearing structure or structures of the latter, the load-bearing structures of superimposed room elements being in vertical register, characterized in that each room element is superimposed by the following steps:

(a) prefabricating sections of the room element, each of which room element sections comprises a prefabricated section of the floor panel structure and any vertical load-bearing structure associated with that panel section in the completed room element, (b) applying to the room element sections substantially all installations, glazing and surface finish associated with each room element section in the completed room element, (c) assembling the room element sections in end-to-end relationship at the factory remote from the building site, with their floor panel sections in substantially a common plane, and (d) rigidly connecting the room element sections, in said relationship, at the factory by structural means uniting the room element sections comprising assembled floor panel sections and vertical load-bearing structures into a rigid structural frame of the room element, thereby forming a rigid and substantially complete room element.

2. A method according to claim 1, wherein, in step (c), at least one horizontal load-bearing structural member is introduced between, and in substantially the same plane as, the floor panel sections of two successive room element sections and, in step (d), said horizontal member is rigidly connected to the floor panel sections and is thereby incorporated into the structural frame.

3. A method according to claim 2 including the step of introducing a horizontal structural member which is a panel member void of any vertical load-bearing structure.

4. A method of constructing a storey of a building from a plurality of transportable room elements each prefabricated from a plurality of room element sections comprising:

(a) prefabricating said sections of transportable room elements, each of which room element sections comprises a section of a floor panel and any vertical load-bearing and non-load-bearing structure associated with that panel section in the completed room element, (b) applying to the room element sections substantially all installations, glazing, and surface finish associated with each room element section in the completed room element, (c) assembling said room element sections edge to edge, (d) rigidly connecting said room element sections by structural means at a location remote from a building site, such means uniting the assembled floor panel sections and vertical load-bearing structures into complete structural units, (e) transporting the transportable room elements to a building site, and (f) assembling the transportable room elements face to face to form a storey of a building.

5. A method of constructing a transportable prefabricated room element from a plurality of room element sections comprising:

(a) prefabricating said sections of the room element, each of which room element sections comprises a section of a floor panel and any vertical load-bearing and non-load-bearing structure associated with that panel section in the completed room element, (b) applying to the room element sections substantially all installations, glazing, and surface finish associated with that room element section in the completed room element, (c) assembling said room element sections edge to edge, and (d) rigidly connecting said room element sections by structural means, such means uniting the assembled floor panel sections and vertical load-bearing structures into a complete structural frame at a location remote from a building site.

6. A method according to claim 5, including the step of connecting the sections of the floor panel, after edge-to-edge assembly, by post-tensioning means.

* * * * *